US006170497B1

(12) United States Patent
Ma

(10) Patent No.: US 6,170,497 B1
(45) Date of Patent: Jan. 9, 2001

(54) UMBRELLA OPENING MECHANISM

(76) Inventor: Joen-Shen Ma, F1. 12, No. 578, Kwang Fu S. Rd., Taipei (TW)

( * ) Notice: Under 35 U.S.C. 154(b), the term of this patent shall be extended for 0 days.

(21) Appl. No.: 09/246,944

(22) Filed: Feb. 9, 1999

(51) Int. Cl.[7] ..... A45B 25/14
(52) U.S. Cl. ..... 135/20.3; 135/15.1
(58) Field of Search ..... 135/20.3, 15.1, 135/28, 29

(56) References Cited

U.S. PATENT DOCUMENTS

| | | | | |
|---|---|---|---|---|
| 4,807,655 | * | 2/1989 | Robertson | 135/22 |
| 4,928,718 | * | 5/1990 | Apple | 135/22 |
| 5,803,102 | * | 9/1998 | Ko | 135/24 |
| 5,806,547 | * | 9/1998 | Derlinga | 135/33.2 |
| 5,845,665 | * | 12/1998 | Koehn | 135/98 |

FOREIGN PATENT DOCUMENTS

| | | | | |
|---|---|---|---|---|
| 143117 | * | 1/1934 | (DE) | 135/20.3 |

* cited by examiner

*Primary Examiner*—Robert Canfield
(74) *Attorney, Agent, or Firm*—Rosenberg, Klein & Lee

(57) ABSTRACT

An umbrella opening mechanism adapted to open an umbrella comprising a shank having a central bore, a crown fixed to a top end of the shank, a runner movable along the shank and rib-stretcher sets connected between the crown and the runner for supporting an umbrella canopy is disclosed. The umbrella opening mechanism includes a winding device manually controlled by a crank arm. A first rope which has a first end fixed to the winding device and is capable to be wound onto the winding device extend through the central bore of the shank with a second end thereof attached to a movable connection element. Two pulleys are fixed to the shank and arranged in two radial holes defined in the shank proximate the crown and in communication with the central bore. A second rope has a center point fixed in the central bore and two half sections slidably extending through and supporting the connection element. Each half section has an end extending out of the shank through the corresponding radial hole and supported by the pulley to be fixed to the runner at two opposite sides. By actuating the winding device to wind the first rope, the connection element is moved and the second rope is pulled into the shank thereby driving the runner toward the crown and thus opening the umbrella.

5 Claims, 5 Drawing Sheets

UMBRELLA OPENING MECHANISM

FIELD OF THE INVENTION

The present invention generally relates to an umbrella, and in particular, to a rope-operated umbrella opening mechanism adapted in a large-sized umbrella, such as a beach umbrella.

BACKGROUND OF THE INVENTION

Large-sized umbrellas, such as beach umbrella and garden umbrella, are well known. A conventional large-sized umbrella is shown in FIG. 1 of the attached drawings, comprising a shank 10 having a crown 11 fixed to a top end thereof. A runner 12 is fit over and axially movable along the shank 10. A plurality of rib-stretcher sets 13 are connected between the crown 11 and the runner 12 for supporting a canopy (not shown) of the umbrella. The shank 10 is separated into an upper and lower sections between which a joint 15 is formed for allowing the upper section to rotate with respect to the lower section in order to change the direction of the umbrella canopy as shown in FIG. 2 for tracking the sun.

A rope-winding device 14 is fixed to the lower section of the shank 10 proximate a lower end thereof winding/unwinding a rope 16. The rope 16 is partially received in an axially-extending central bore (not shown) of the shank 10. The rope 16 extends from the rope-winding device 14, through the joint 15 and a roller or pulley (not shown) rotatably fixed to the shank 10 proximate the crown 11, and is connected to the runner 12 whereby by actuating the rope-winding device 14 by means of a crank arm 17 to wind/unwind the rope 16 onto/from the rope-winding device 14, the runner 12 is moved toward/away from the crown 11 for opening/closing the umbrella.

Such a conventional umbrella opening mechanism, however, has disadvantages. For example, since the runner 12 is driven by a single rope 16 that is attached to the runner 12 at one side thereof thereby leading to a force unbalanced condition which causes a frictional engagement between one side of the runner 12 and the shank 10. A smooth movement of the runner 12 is thus prohibited.

Attaching two ropes to two opposite sides of the runner is an idea solution for the force-unbalancing problem. However, since the joint 15 which provides only a very limited space for the two ropes to simultaneously extend therethrough, it is not possible to connect two ropes between the runner 12 and the rope-winding device 14.

It is thus desirable to have an umbrella opening mechanism that overcomes the problems encountered in the prior art designs of the large-sized umbrellas.

SUMMARY OF THE INVENTION

Accordingly, an object of the present invention is to provide an umbrella opening mechanism which moves a runner in a force balanced fashion thereby solving the problems of one side friction and un-smooth movement of the runner.

Another object of the present invention is to provide an umbrella opening mechanism which overcomes the above problems without simultaneously connecting two ropes between the runner and a rope-winding device whereby limitations caused by the joint on the existence of the two ropes is eliminated.

To achieve the above objects, in accordance with the present invention, there is provided an umbrella opening mechanism adapted to open an umbrella comprising a shank having an axially-extending central bore, a crown fixed to an axial top end of the shank, a runner axially movable along the shank and rib-stretcher sets connected between the crown and the runner for supporting an umbrella canopy, and comprising a rope-winding device manually controlled by a crank arm. A first rope which has a first end fixed to the rope-winding device and which is capable to be wound onto the winding device extend through the central bore of the shank with a second end thereof attached to a movable connection element. Two pulleys are fixed to the shank and arranged in two radial holes defined in the shank proximate the crown and in communication with the central bore. A second rope has a center point fixed in the central bore and two half sections slidably extending through and supporting the connection element. Each half section has an end extending out of the shank through the corresponding radial hole and supported by the pulley to be fixed to the runner at two opposite sides. By actuating the rope-winding device to wind the first rope, the connection element is moved and the sections of the second rope are pulled into the shank thereby driving the runner toward the crown and thus opening the umbrella.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF THE PREFERRED EMBODIMENTS

Figure 2:
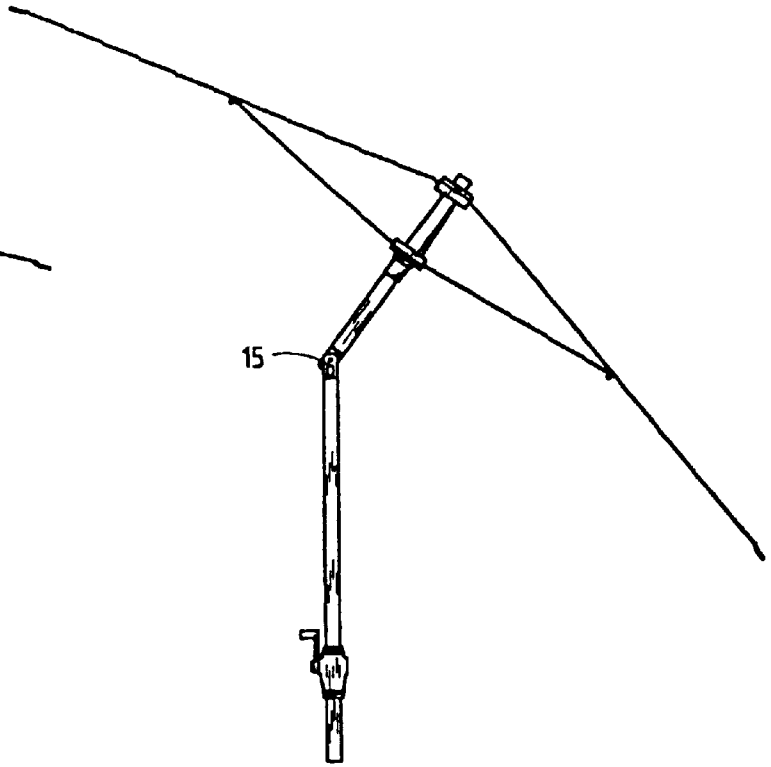
FIG.2 PRIOR ART
FIG. 2 is a schematic view of the convention umbrella with an upper section thereof being rotated to be inclined with respect to the lower section.
Figure 1:
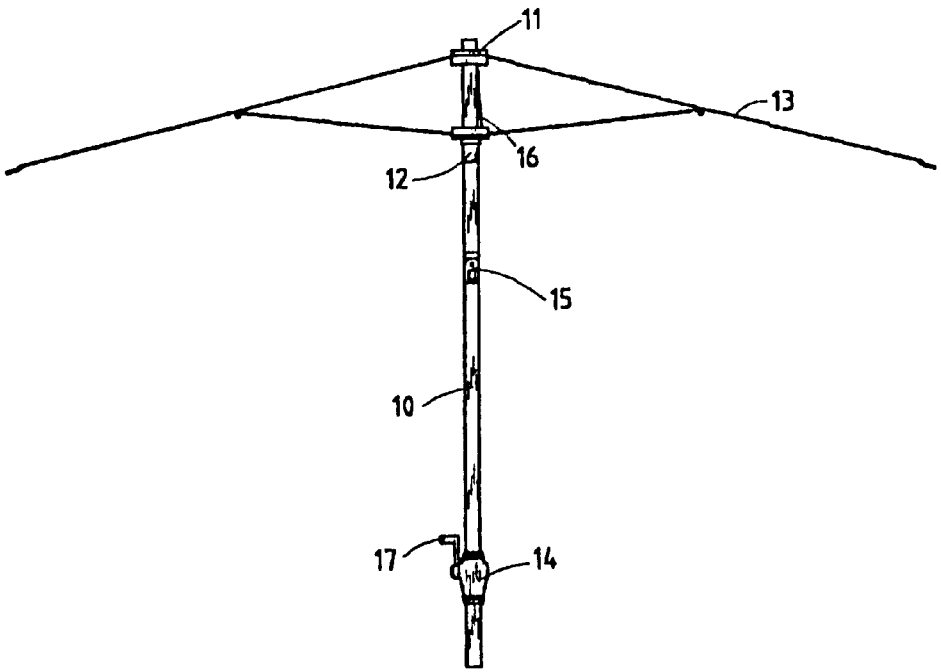
FIG.1 PRIOR ART
FIG. 1 is a schematic view showing a conventional umbrella with a canopy of the umbrella removed.
Figure 4:
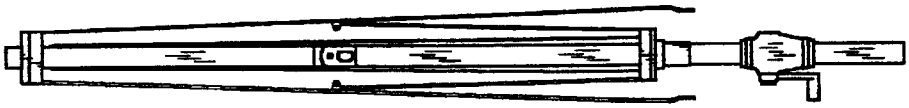
FIG. 4 is the umbrella of FIG. 3 in a closed condition.
Figure 3:
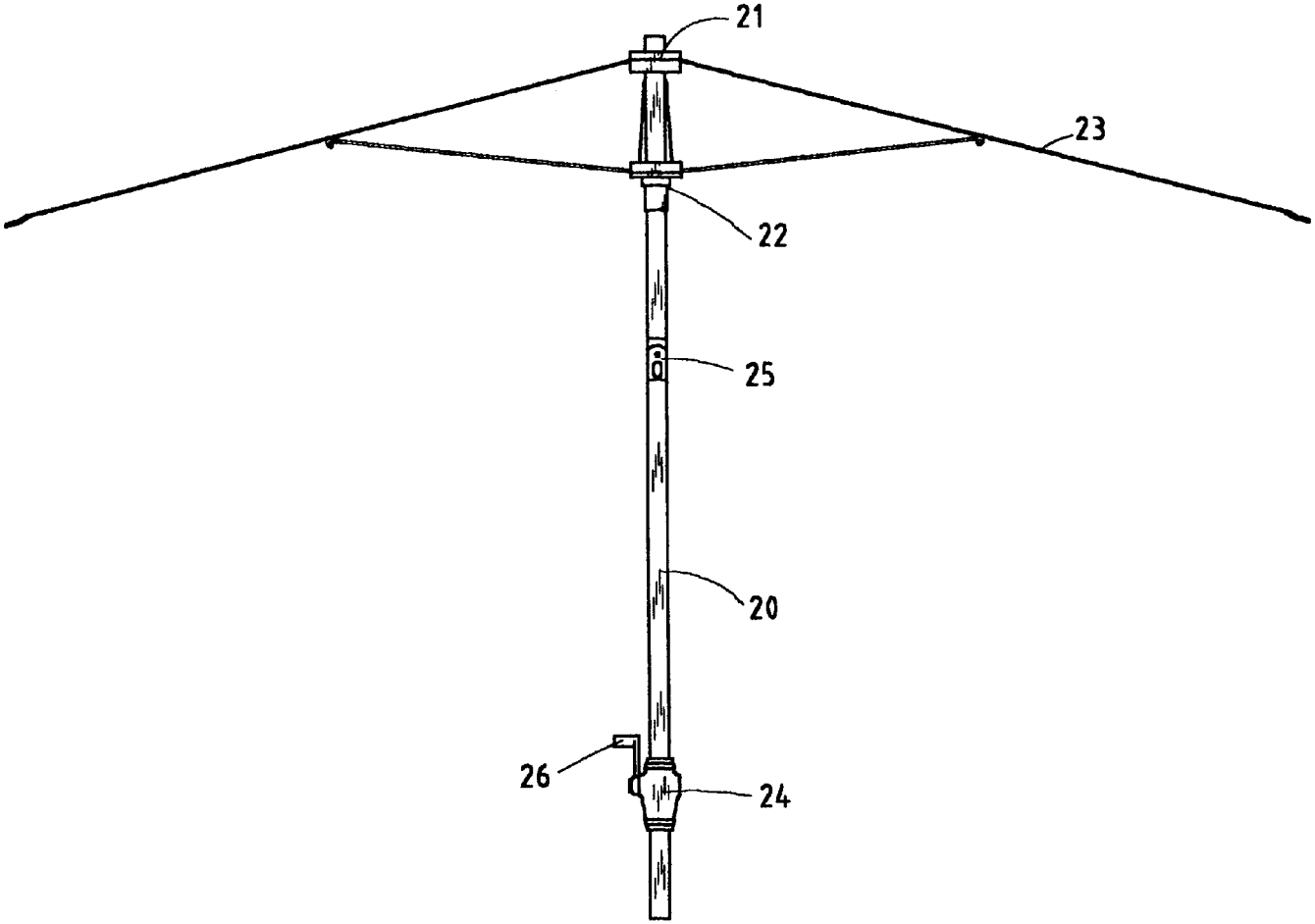
FIG. 3 is a schematic view of an umbrella comprising an umbrella opening mechanism in accordance with the present invention.

With reference to the drawings and in particular to FIGS. 3 and 4, wherein an umbrella is shown with an umbrella canopy removed for simplicity, the umbrella comprises a shank 20 having a crown 21 fixed to a top end thereof. A runner 22 is fit over and axially movable along the shank 20. A number of rib-stretcher sets 23 are connected between the crown 21 and the runner 22 for supporting the umbrella canopy (not shown). The shank 20 is separated into an upper section and a lower section with a joint 25 arranged therebetween for allowing the umbrella canopy to change direction. A rope-winding device 24 operable by means of a crank arm 26 is fixed to the lower section of the shank 20 for moving the runner 22 along the shank 20 to open/close the umbrella. An open condition and a closed condition of the umbrella are respectively shown in FIGS. 3 and 4.

Figure 5:
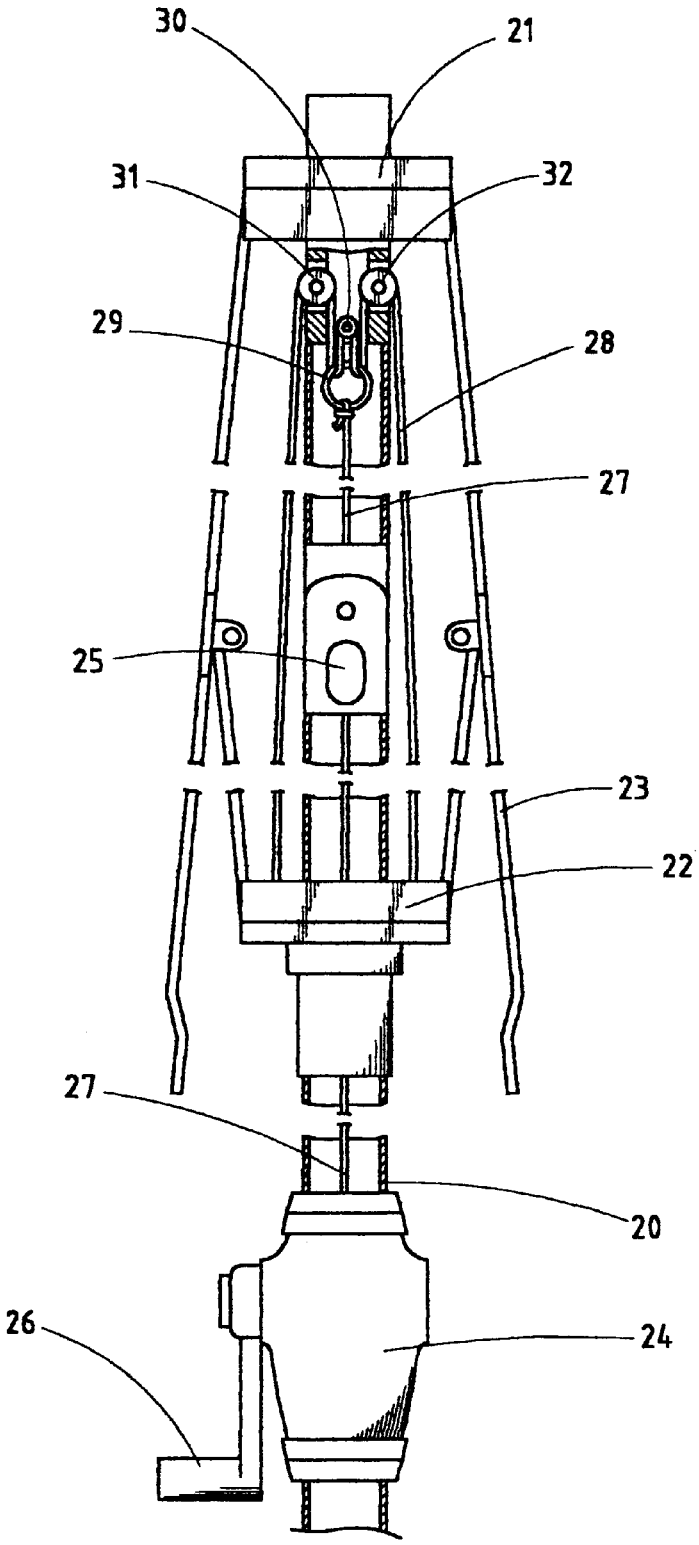
FIG. 5 is a detailed view of the umbrella of FIG. 4 showing an inside structure thereof in a closed condition.

As shown in FIG. 5, a primary rope 27 having an end fixed to the rope-winding device 24 extends through an axially-extending central bore (not labeled) of the shank 20 to have a second end thereof fixed to a ring-like connection element 29. The shank 20 has two opposite radial holes defined therein in communication with the central bore thereof proximate the crown 21. Two pulleys 31, 32 are respectively arranged in the holes and rotatably fixed to the shank 20. A fixed point 30 is provided therebetween in the central bore of the shank 20. A secondary rope 28 has a center point fixed to the fixed point 30 of the shank 20 with two half sections thereof extending through the ring 29 with ends thereof extending out of the shank 20 through the radial holes by having the secondary rope 28 supported by the pulleys 31, 32. The ends of the secondary rope 28 are fixed to the runner 22.

Figure 6:
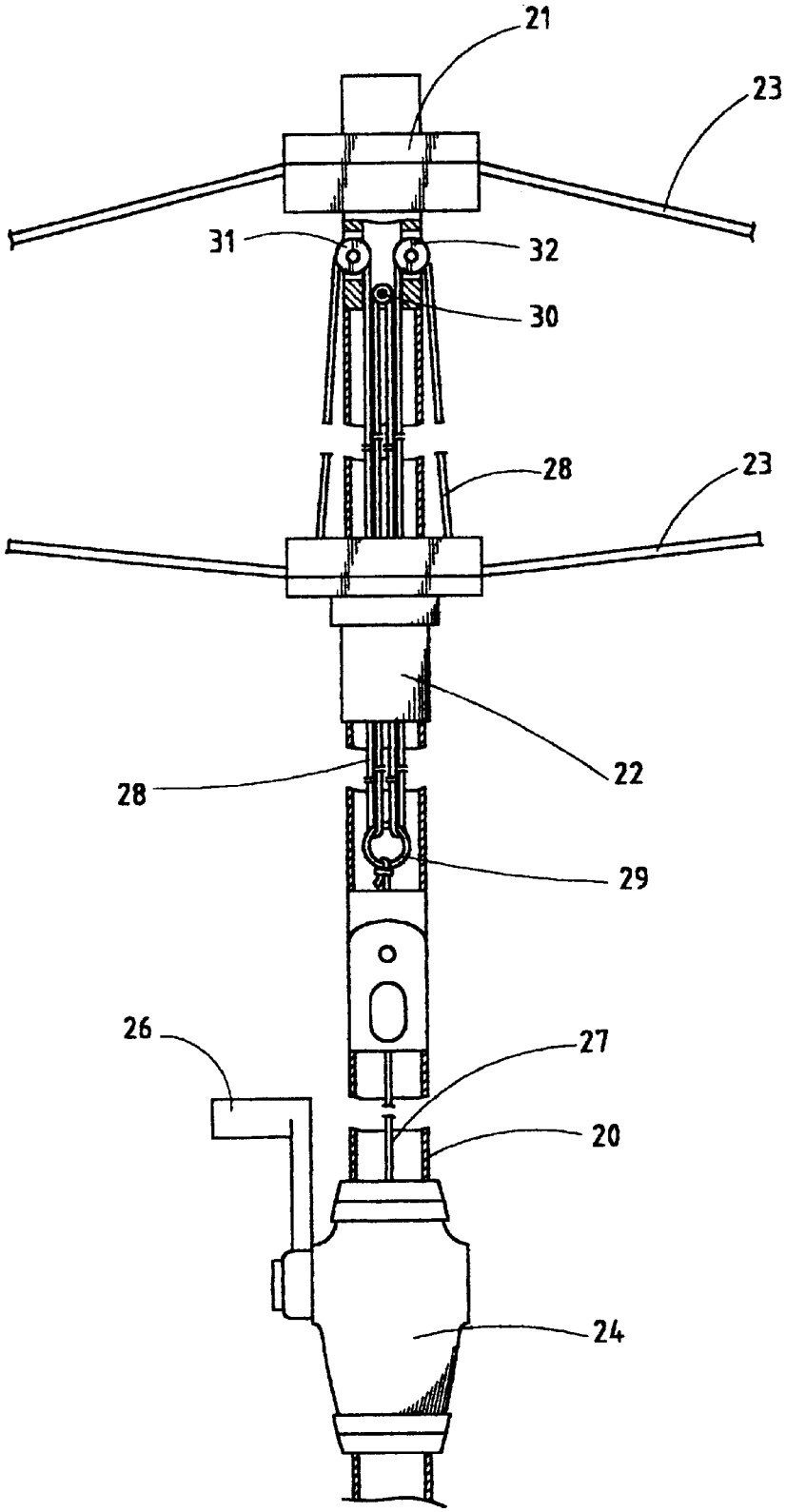
FIG. 6 is a view similar to FIG. 5 but is in an open condition.

Actuating the rope-winding device 24 to wind the primary rope 27 for moving the runner 22 causes the ring 29 to move toward the rope-winding device 24 which in turn pulls the two half sections of the secondary rope 28 into the shank 20 thereby driving the runner 22 toward the crown 21 and thus opening the umbrella as shown in FIG. 6.

By means of the arrangement described above, only the primary rope 27 needs to extend through the joint 25 and the second rope 28 does not. This overcomes the problem caused by having two ropes simultaneously extending through the joint 25.

Figure 7:
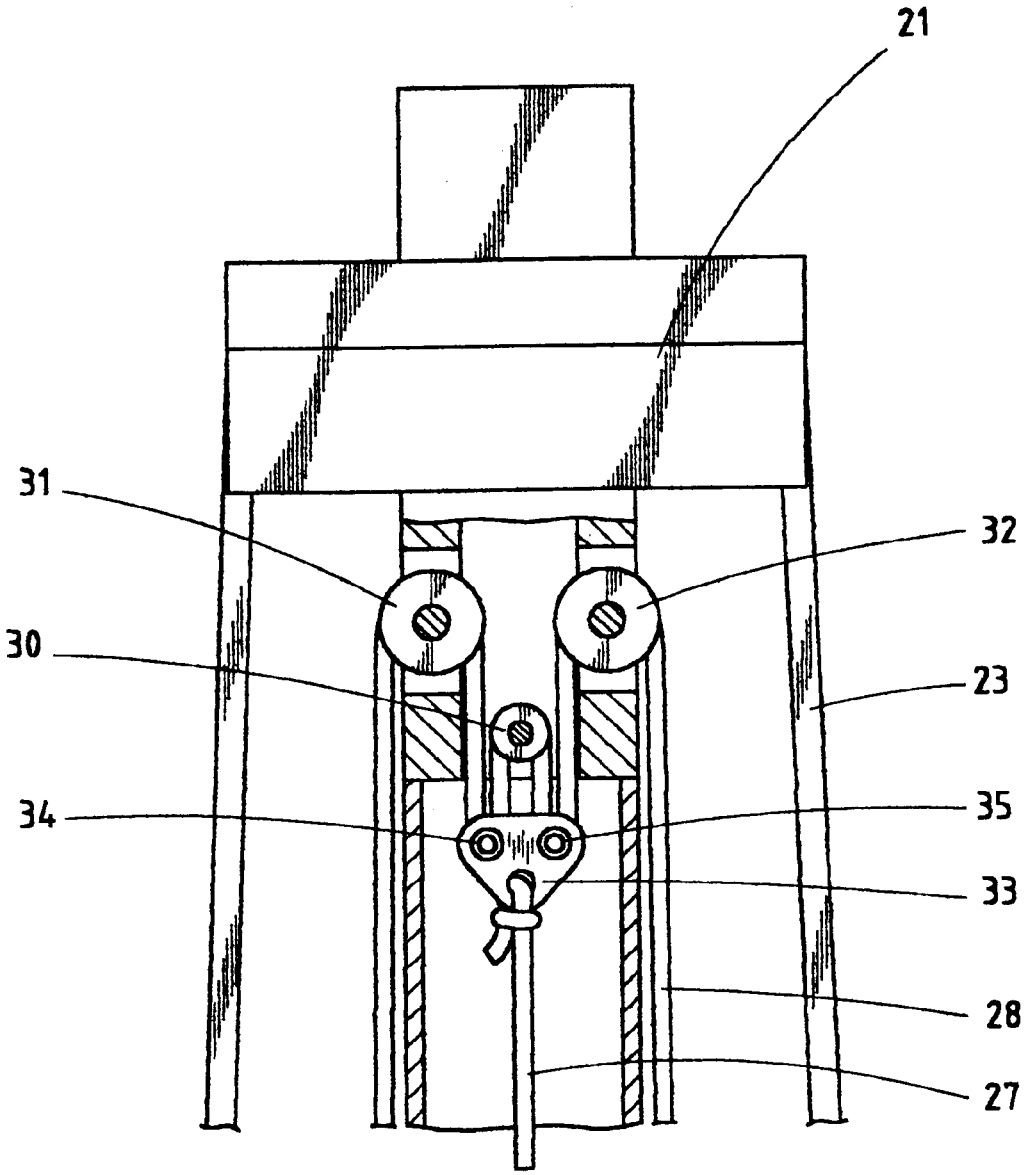
FIG. 7 is a schematic view of an umbrella comprising an umbrella opening mechanism in accordance with a second embodiment of the present invention.

Preferably, the ring 29 has a smooth surface that allows the secondary rope 28 to slide thereover without a significant friction therebetween. However, it is quite apparent that the connection element 29 may be provided with rollers or pulleys for a more smooth support of the two halves of the secondary rope 28. This is shown in FIG. 7 in which the connection element 29 is no longer a ring. Instead, the connection element 29 to which the primary rope 27 is fixed has two rollers 34, 35 rotatably fixed thereon for supporting the secondary rope 28.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An umbrella opening mechanism adapted to open an umbrella comprising a shank having an axial central bore, a crown fixed to a top end of the shank, a runner movable along the shank and a number of rib-stretcher sets connected between the crown and the runner for supporting an umbrella canopy, the umbrella opening mechanism comprising a rope-winding device, a first rope having a first end fixed to the rope-winding device and being windable thereunto, the first rope extending through the central bore of the shank to have a second end thereof attached to a connection element movable along the central bore, two pulleys being fixed to the shank and arranged in two radial holes defined in the shank at two opposite sides thereof and in communication with the central bore proximate the crown, a second rope having a center point fixed in the central bore and two half sections slidably extending through and supporting the connection element, each half section having an end extending out of the shank through the corresponding radial hole and supported by the corresponding pulley, the ends being fixed to the runner at two opposite sides.

2. An umbrella opening mechanism as claimed in claim 1, wherein the connection element comprises a ring to which the second end of the first rope is fixed, both half sections of the second rope extending through the ring.

3. An umbrella opening mechanism as claimed in claim 2, wherein the ring has a smooth surface.

4. The umbrella opening mechanism as claimed in claim 1, wherein the connection element comprises two rollers rotatably fixed thereon for each supporting one half section of the second rope.

5. The umbrella opening mechanism as claimed in claim 1, wherein the shank comprises an upper section and a lower section with a joint connecting therebetween.

* * * * *